US009663189B2

(12) United States Patent
Mitrovich

(10) Patent No.: US 9,663,189 B2
(45) Date of Patent: May 30, 2017

(54) LIGHTWEIGHT POWER BOAT CONCEPT

(71) Applicant: Svetislav Mitrovich, Spokane Valley, WA (US)

(72) Inventor: Svetislav Mitrovich, Spokane Valley, WA (US)

(73) Assignee: Svetislav Mitrovich

( * ) Notice: Subject to any disclaimer, the term of this patent is extended or adjusted under 35 U.S.C. 154(b) by 0 days.

(21) Appl. No.: 14/545,521

(22) Filed: May 15, 2015

(65) Prior Publication Data

US 2016/0332698 A1 Nov. 17, 2016

(51) Int. Cl.

| | |
|---|---|
| ***B63B 1/12*** | (2006.01) |
| ***B63B 1/26*** | (2006.01) |
| *B63B 1/20* | (2006.01) |

(52) U.S. Cl.

CPC ..... *B63B 1/125* (2013.01); *B63B 1/26* (2013.01); *B63B 2001/208* (2013.01)

(58) Field of Classification Search

CPC ..... B63B 2001/207; B63B 2001/209; B63B 2001/325; B63B 1/322; B63B 1/105; B63B 2001/208; B63B 1/26

See application file for complete search history.

(56) References Cited

U.S. PATENT DOCUMENTS

| | | | | | |
|---|---|---|---|---|---|
| 4,095,549 | A * | 6/1978 | Williams | B63B 1/125 | 114/123 |
| 5,054,411 | A * | 10/1991 | Nelson | B63B 15/02 | 114/39.24 |
| 5,522,333 | A * | 6/1996 | Lang | B63B 1/107 | 114/274 |
| 5,813,358 | A * | 9/1998 | Roccotelli | B60V 1/08 | 114/272 |
| 8,695,520 | B1 * | 4/2014 | Berte' | B63B 1/14 | 114/39.27 |

* cited by examiner

*Primary Examiner* — Andrew Polay

(57) ABSTRACT

A three hulled T configuration displacement power boat that reduces weight by minimizing the structural without sacrificing boat length. The weight is evenly distributed between three hulls and is aligned in a T formation so that the overall boat length would be about three times the hull length. The structure, cargo and passenger(s) are supported above the water as shown in FIG. 1.

1 Claim, 4 Drawing Sheets

LIGHTWEIGHT POWER BOAT CONCEPT

BACKGROUND OF THE INVENTION

1. Field of Invention

This invention relates to a power boats design that can significantly reduce weight over present art forms. The invention is applicable to lightly loaded cruising power boats used in off-shore protected waterways where speed and seaworthiness are of primary importance.

2. Description of the Background

In the art of designing cruising power boats, whether mono or multi-hull, it is well recognized that longer boats offer greater speed and seaworthiness. For mono hulls cruising speed is limited to about 1.5×square root of the waterline length. This is the speed that boats travels in displacement mode and is referred to as max displacement speed. Above this speed boats start to plane and are easily recognized by the high angle of attack. Off shore mono-hull boats are not normally run in planing mode because of high fuel use and uncomfortable pounding from waves. For stability mono-hull boats have a length beam ratio between 3 to 1 and 4 to 1.

Multi-hull boats have hull length beam ratio of 8 to 1 or more. These narrow hulls are less affected at max displacement speed and can travel faster without planing. However power multi-hull boats generally weighs as much as mono hulls for the same length. The drawbacks of these designs are that weight, power required and cost increases significantly with size. It is the primary object of the present invention to provide a means for minimizing power boat structural weight without impacting boat length and stability with three hulls in a T configuration.

It is also an object of this invention is to provide hulls for this boat that allows high speeds and superior seaworthiness.

SUMMARY OF THE INVENTION

My concept for reducing structural weight without affecting overall length and stability is to use three about equal size hulls that are about ⅓ boat length.

In this discussion, boat/hull length always refers to waterline length, and about means+/−15%.

These hulls are held together in a T formation with one hull in front and two in back with one hull length separating two back hulls.

A frame, above water, holds the hulls, and a platform on the frame holds load. Motor is mounted on frame, platform or in hulls if large enough. One can think of this concept as three hulls forming the base of a tripod and a frame sufficiently strong to hold load on the base.

For high speed and seaworthiness the hulls in this tri-hull configuration most meet the following parameters:

- each hull having a length to beam of 8 to 1 or more,
- each hull having vertical sides within + or −8 degrees,
- each hull having vertical height about ⅓ hull length,
- each hull having sharp bow and stern and angled back about 10 to, 30 degrees,
- each hull having a flat bottom profile,
- each hull having strakes, and
- each hull having foils at bottom located close to hull's center of buoyancy.

The combine set of foils support 30 to 80% of boat dry weight with motor at cruising speed.

These hulls accomplish the following:

- minimize wetted area, as a very narrow mono-hull,

- smooth ride because of the small boat footprint on the water and vertical hull sides, and
- level cruising at all displacement speeds since the each hull is equally affected by any rotational force.

The frame can be attached directly to the hulls or spaced higher with struts to give greater water clearance. The frame can be two leveled to give greater clearance to back section.

DETAIL DESCRIPTION OF THE PREFERRED EMBODIMENTS

Figure 1:
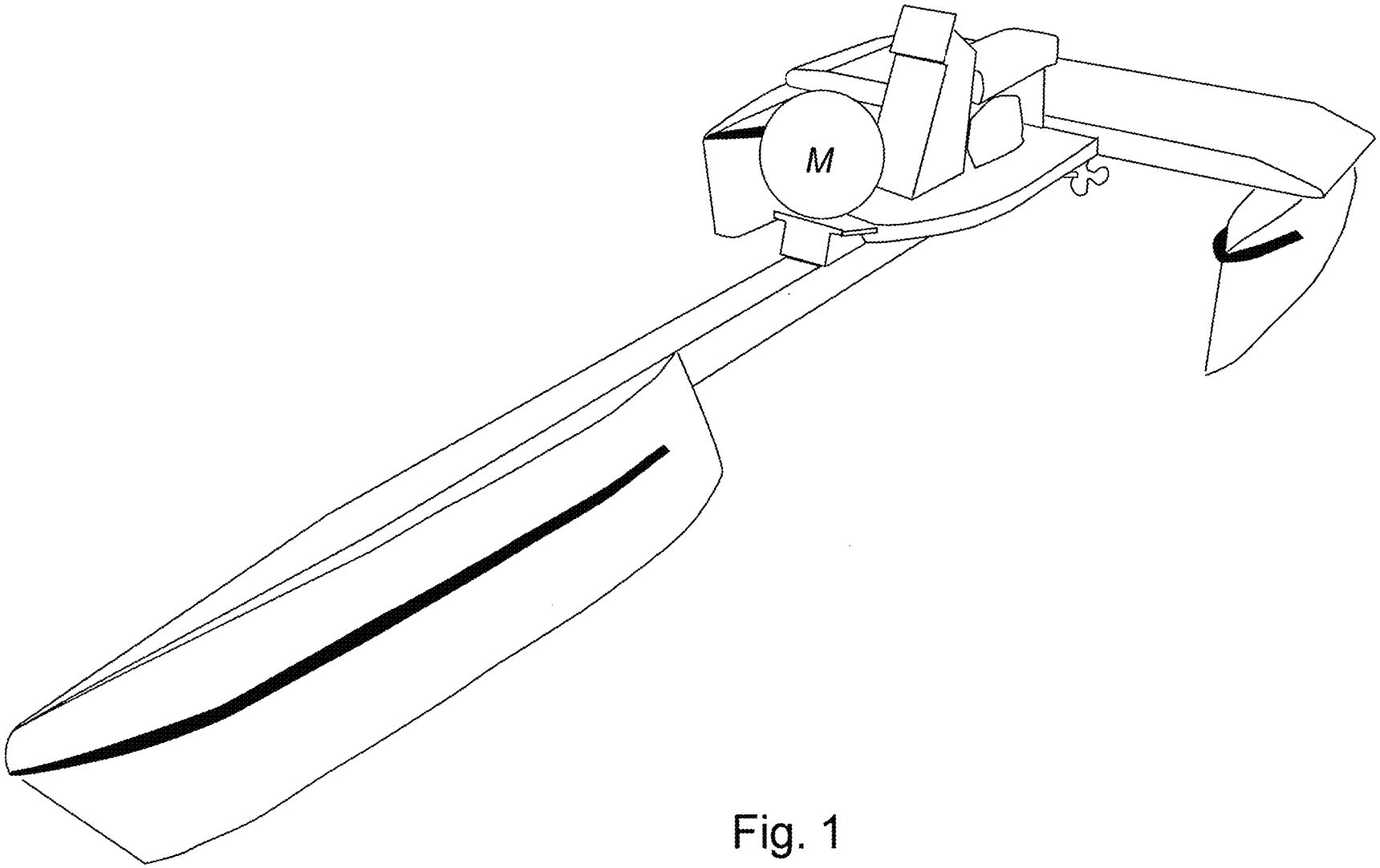
FIG. 1—Plan view of test model showing three equal size hulls in T configuration.

Over the last 5 years have I've made and tested a 19.5' boat with 7' hulls per above design parameters. With a 20 hp motor this boat travels 18.5 mph in displacement mode and reaches this speed staying level. Boat's dry weight with motor is about 450 lbs.

The top speed for this test model works out to be 5.8×square root of hull length with foils that support about 30% of boat dry weight.

Because the hulls are ⅓ length, true comparison would be 3.3×square root of overall boat length which is about twice the cruising speed of a mono hull power boat.

The preferred embodiment would consist of three hulls 1 that are about ⅓ boat length and met the following design parameters:

- Length to beam ratio of 8 to 1
- Vertical sides+/−6 degrees,
- Hull height about ⅓ of hull length
- Sharp bow and stern angled back 25 degrees,
- Flat bottom,
- Front strakes 4, half length of hull,
- Foils 6, near center of buoyancy, large enough to support 50% of boat dry weight with motor at cruising speed.

Figure 2:
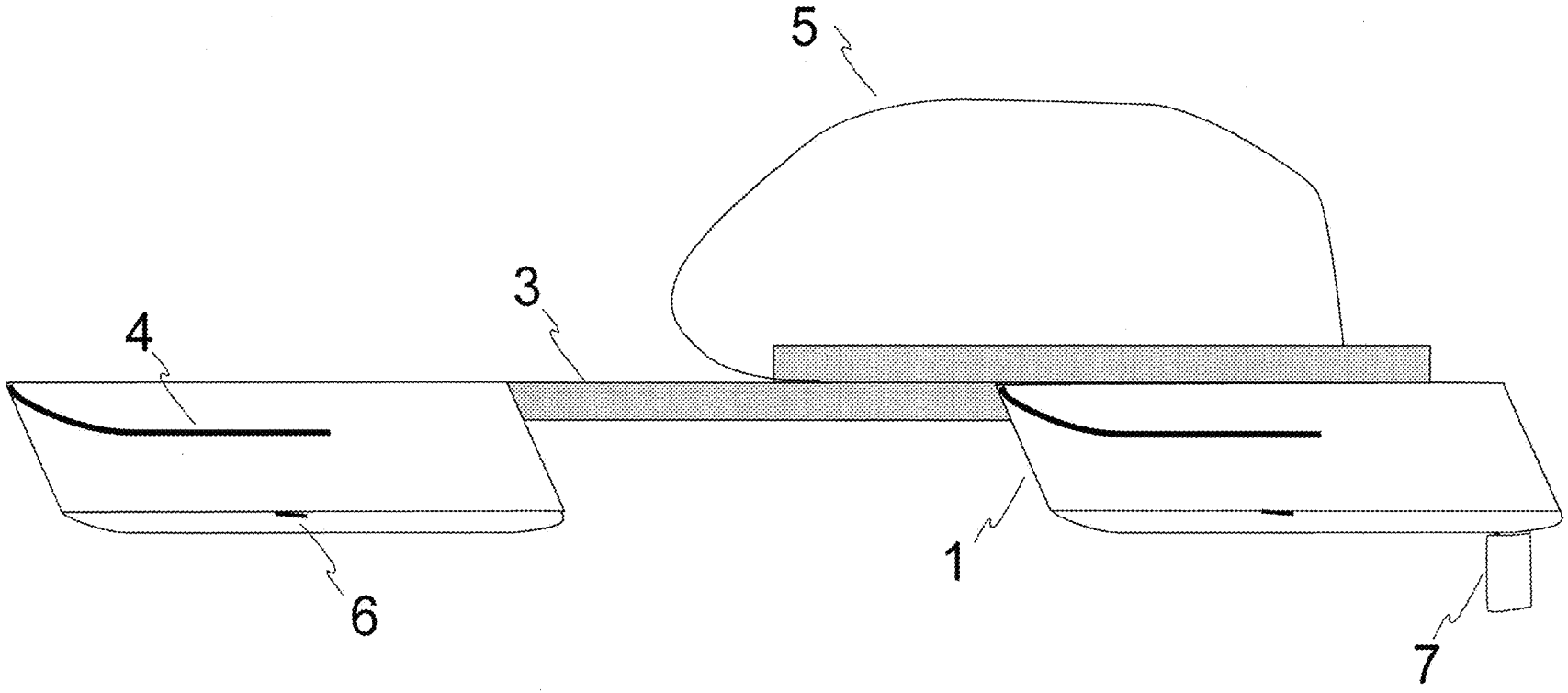
FIG. 2—Side view showing the preferred embodiment of hulls, Frame, load platform, load, and position of lifting foils.
Figure 3:
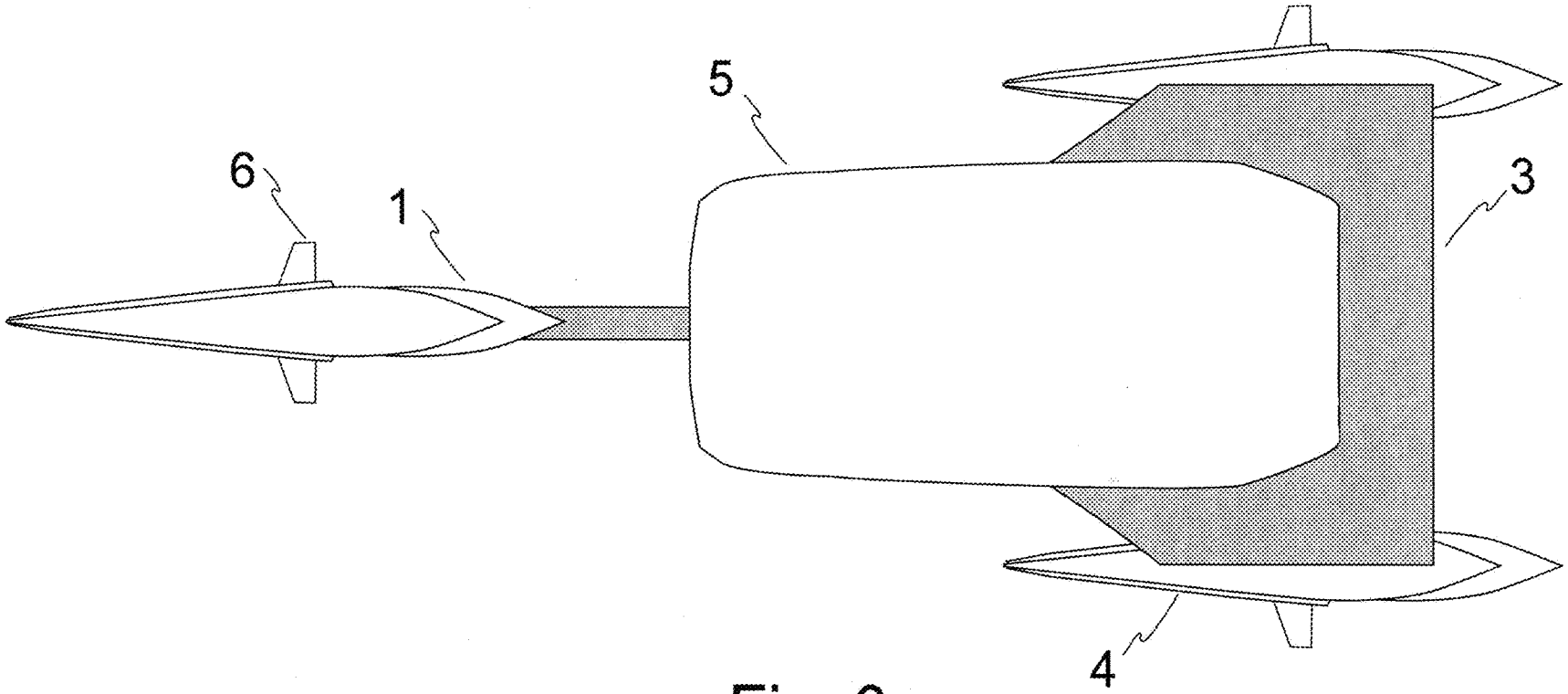
FIG. 3—Top view showing the preferred embodiment of hulls, load platform, load, strakes and foils.
Figure 4:
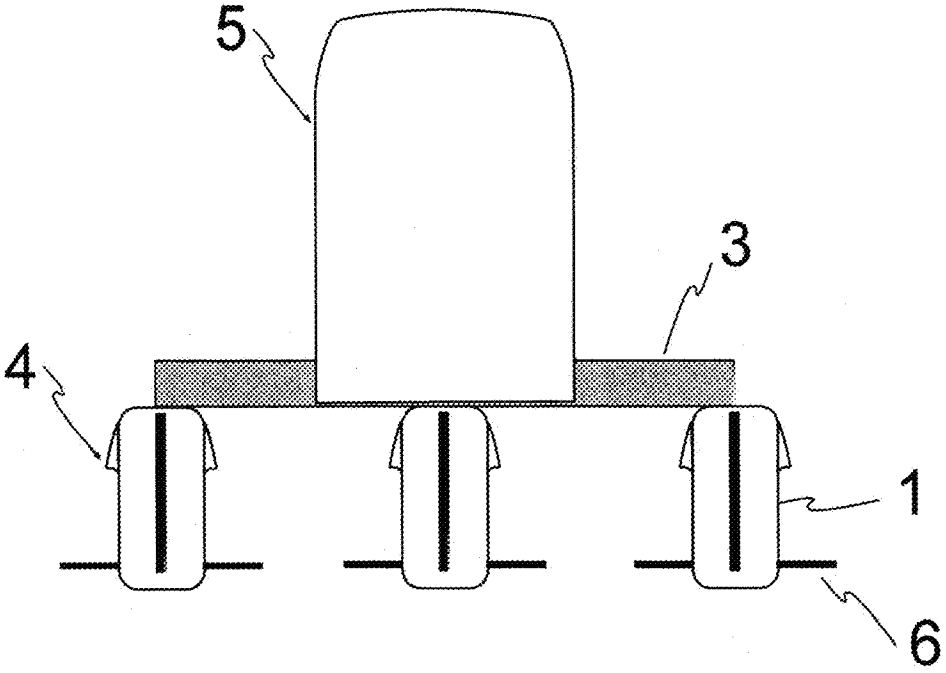
FIG. 4—Front view showing preferred embodiment.

The preferred embodiment would have load platform/load 5 and motor as centrally located as possible to the center of flotation per FIG. 1 and rudders 7 mounted on back of back hulls as shown in FIG. 2

According to preferred embodiment being described frame 3 can be held above the hulls by struts for more water clearance. Part of the frame holding back two side hulls can be raised even higher to give still greater water clearance in back.

Per preferred embodiment strakes 4 would control water spray and help keep hulls from getting buried in large waves.

Per preferred embodiment the combined foils would lift about 50% of the boat's all up weight at cruising speed.

Alternative embodiment with big enough hull would be to mount motors in back hulls and do away with rudders 7. To balance motor weight in back hulls the platform with load would have to be located further forward. Alternative embodiment would make said foils' angle of attack adjustable to best balance speed, water clearance and turn control.

The invention claimed is:

1. A power boat for travelling at service speed, most suitable for off shore protected waterways comprising:

a) three semi-displacement hulls of equal length and equal beam, each about ⅓ of overall boat length, wherein the three hulls comprise two aft hulls and one forward hull, each hull has vertical or nearly vertical sides and a pointed bow;

b) a frame above a surface of the water at gross weight, said frame fixing said hulls in a right angle T-formation with about one hull length longitudinal distance between said two aft hulls and said forward hull;

c) a load platform on said frame to support a load;

d) a motor mounted on said platform that drives a propeller under the surface of the water;

e) a foil mounted on each port and starboard side of each hull at the longitudinal midpoint of each of said hulls, each foil extends laterally from each hull;

f) a rudder mounted on the keel of each of said rear hulls;

g) longitudinal strakes mounted on a forward portion of each of said hulls above the surface of the water.

* * * * *